US009282806B2

(12) United States Patent
Vierthaler et al.

(10) Patent No.: US 9,282,806 B2
(45) **Date of Patent: *Mar. 15, 2016**

(54) ARTICULATED FRONT ACCESSIBLE BACKPACK

(71) Applicant: XDesign, LLC, Eastsound, WA (US)

(72) Inventors: Paul R. Vierthaler, Eastsound, WA (US); Charles S. Lewis, III, Eastsound, WA (US); Catherine R. Vierthaler, Eastsound, WA (US)

(73) Assignee: XDesign, LLC, Eastsound, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/576,676

(22) Filed: Dec. 19, 2014

(65) Prior Publication Data

US 2015/0102082 A1 Apr. 16, 2015

Related U.S. Application Data

(63) Continuation-in-part of application No. PCT/US2013/047264, filed on Jun. 24, 2013.

(51) Int. Cl.

| | |
|---|---|
| ***A45F 3/10*** | (2006.01) |
| ***A45F 3/08*** | (2006.01) |
| ***A45F 3/04*** | (2006.01) |

(52) U.S. Cl.

CPC ... *A45F 3/04* (2013.01); *A45F 3/08* (2013.01); *A45F 3/10* (2013.01)

(58) Field of Classification Search

CPC ..... A45F 3/14; A45F 3/08; A45F 2003/148; A45F 2005/025; A45F 2005/027; A45F 2005/028; A45F 3/04; A45F 3/10

USPC ..... 224/634, 575, 581–583, 195, 197, 631, 224/646, 628, 633, 185, 600, 627, 261–262, 224/648–649, 257, 259

See application file for complete search history.

(56) References Cited

U.S. PATENT DOCUMENTS

| | | | |
|---|---|---|---|
| 1,601,624 | A | 9/1926 | Houghton |
| 3,106,037 | A | 10/1963 | Harkey |

(Continued)

FOREIGN PATENT DOCUMENTS

| | | | |
|---|---|---|---|
| GB | 2228191 | A | 8/1990 |
| WO | 0197650 | A1 | 12/2001 |

OTHER PUBLICATIONS

International Search Report and Written Opinion, App. No. PCT/US2013/047264, pp. 1-9, completed Nov. 7, 2013, Alexandria, Virginia, U.S.

Machine English Translation of Description of WO2001/097650.

*Primary Examiner* — Justin Larson

*Assistant Examiner* — Scott McNurlen

(74) *Attorney, Agent, or Firm* — Morriss O'Bryant Compagni

(57) ABSTRACT

Backpacks and backpack systems which have at least a portion which is accessible from the front of a wearer. In one illustrative embodiment, a backpack system in accordance with the present invention includes a back portion with shoulder straps. A swing-around portion is formed as a storage compartment that is secured to the back portion in a carrying position. An articulated frame is secured to the back portion and the swing-around portion and allows a user wearing the backpack to pivot the swing around portion around the user's side and access the contents therein. A securing latch is used to secure the articulating frame to retain the swing-around portion in the carrying position. The entire storage compartment of the pack may be a swing-around portion, or the pack may include multiple storage compartments that are either fixed to the back portion or function as swing-around portions.

20 Claims, 8 Drawing Sheets

(56) References Cited

U.S. PATENT DOCUMENTS

| | | | |
|---|---|---|---|
| 4,114,788 | A | 9/1978 | Zufich |
| 4,662,551 | A | 5/1987 | Dudley et al. |
| 4,919,443 | A | 4/1990 | Kehler |
| 5,337,934 | A | 8/1994 | Johnson et al. |
| 5,437,403 | A | 8/1995 | Lemanski, II |
| 5,564,612 | A | 10/1996 | Gregory |
| 5,590,825 | A | 1/1997 | Murdock |
| 5,657,917 | A | 8/1997 | Johnson et al. |
| 5,732,867 | A | 3/1998 | Perkins et al. |
| 6,402,003 | B1 | 6/2002 | Jackson |
| 6,837,409 | B2 | 1/2005 | Lemanski, II |
| 7,293,681 | B2 | 11/2007 | Wills |
| 7,316,340 | B2 | 1/2008 | Marik |
| 7,344,055 | B2 | 3/2008 | Macocha |
| 7,681,769 | B2 | 3/2010 | Kramer |
| 7,996,921 | B1 | 8/2011 | Snyder |
| 8,070,030 | B2 | 12/2011 | Marik |
| 2004/0065704 | A1 | 4/2004 | Penny et al. |
| 2007/0295774 | A1 | 12/2007 | Matschke |
| 2008/0302839 | A1 | 12/2008 | Murdoch et al. |

ARTICULATED FRONT ACCESSIBLE BACKPACK

CROSS-REFERENCE TO RELATED APPLICATION

This application is a continuation-in-part of International Application PCT/US2013/047264 filed Jun. 24, 2013, which claims priority to U.S. application Ser. No. 13/535,006, filed Jun. 27 18, 2012. The disclosures of each of these related applications are incorporated herein by reference in their entirety.

TECHNICAL FIELD

The present invention relates to backpacks for carrying articles and more particularly to backpacks that can be accessed without removing the backpack from a user's body.

BACKGROUND

Backpacks have long been used for carrying articles on one's back. A traditional backpack design places the load in a bag which has shoulder straps passing over the user's shoulders to support it. In order to access articles in the bag portion, a user must remove the backpack from their shoulders. If a hiker wants to access a camera to take a photograph or binoculars to view something up close, the time to remove the backpack and retrieve the item may cost them the opportunity.

Past attempts to create a backpack that is accessible from the front include packs that have strap arrangements that allow the bag portion to be slid or lifted around the body of a user for access upon removal of a strap. U.S. Pat. Nos. 5,437,403 and 7,316,340, the disclosures of which are incorporated herein by reference in their entireties, are examples of such attempts. However, these may be awkward for the user to manipulate and require the user to have to reposition the shoulder straps.

Other prior attempts include backpacks with a portion that can be detached from the main bag and flipped over a wearer to the front. For example, US Patent Application Publication 2007/0295774, the disclosure of which is incorporated herein in its entirety, discloses a backpack with a detachable "flip" bag that can be brought forward over user's shoulder. Similarly, U.S. Pat. No. 7,681,169, the disclosure of which is incorporated by reference herein, discloses a backpack consisting of a harness secured to a user with a moveable compartment which is secured on a user's back when stowed, but can be rotated over the user's head to an accessible front position. The systems of the '169 patent is elaborate and both it and the system of the '774 Publication have the shortcoming that items placed in the movable compartment or flip bag are inverted when brought in front of the wearer, placing the contents therein upside down when compared to the carrying position.

A backpack that used a simple mechanism to allow a user to access the contents thereof from the front without removing the backpack would be an improvement in the art. Such a backpack that provided this access without inverting the storage portion of the backpack would be a further improvement in the art.

SUMMARY

The present invention is related to backpacks which have at least a portion which is accessible from the front of a wearer.

In one illustrative embodiment, a backpack system in accordance with the principles of the present invention includes a back portion with shoulder straps for carrying the pack by user. In some embodiments, a belt strap may be attached to the back portion as well. A swing-around portion of the back pack is formed as a storage compartment that is secured to the back portion in a carrying position. An articulated frame is secured to the back portion and the swing-around portion and allows a user wearing the backpack to pivot the swing around portion around the user's side and access the contents therein. The securing latch is used to secure the articulating frame to retain the swing-around portion in the carrying position. In some embodiments, the entire storage compartment of the pack may be the swing-around portion, while in others the pack may include multiple storage compartments that are either fixed to the back portion or function as swing-around portions.

Backpack systems and kits for modifying existing backpacks to include a swing around portion are also included in the present invention.

DESCRIPTION OF THE DRAWINGS

It will be appreciated by those of ordinary skill in the art that the various drawings are for illustrative purposes only. The nature of the present invention, as well as other embodiments of the present invention, may be more clearly understood by reference to the following detailed description, to the appended claims, and to the several drawings.

DETAILED DESCRIPTION

The present invention relates to apparatus, systems and methods for carrying items in a backpack and being able to access those items from in front while wearing the backpack. It will be appreciated by those skilled in the art that the embodiments herein described, while illustrating certain embodiments, are not intended to so limit the invention or the scope of the appended claims. Those skilled in the art will also understand that various combinations or modifications of the embodiments presented herein can be made without departing from the scope of the invention. All such alternate embodiments are within the scope of the present invention.

Figure 1:
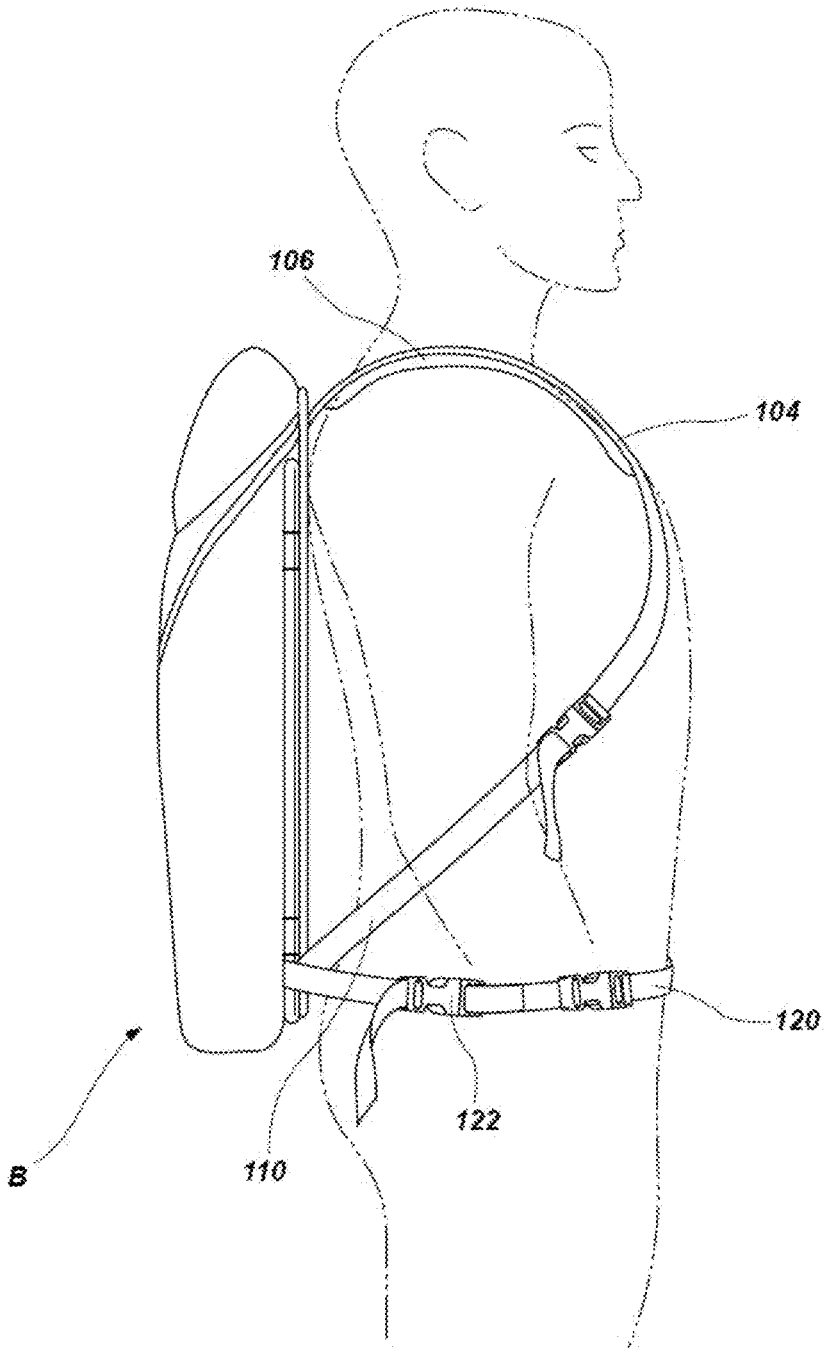
FIG. 1 is a side view of a user wearing a backpack system in accordance with one embodiment of the present invention in an undeployed or carrying configuration.

Referring to FIGS. 1 through 6, there is depicted a backpack system B in accordance with the present invention. As depicted in FIG. 1, the system B may be worn in the same fashion as a typical daypack. System B includes a back portion 100 to which two shoulder straps 102 and 104 are attached for carrying the pack by placement of the straps over a user's shoulders in the standard fashion. As depicted, the shoulder straps 102 and 104 may be attached to back portion 100 near the upper and lower edges thereof from the front surface. It will be appreciated that other attachment points may also be used as may be desirable for a specific embodiment.

As in the depicted embodiment, each of shoulder straps 102 and 104 may consist of an upper portion 106 for passing over the shoulders, which may be padded through a length thereof. At a distal end, the upper portion may terminate in a buckle 108 through which it is connected to a lower portion 110 which is connected at its other end to the back portion 100. The operative length of the strap 102 or 104 may be adjusted by altering the position of buckle 108 on lower portion 110.

A belt strap 120 may be attached to the back portion 100 on opposite points of the two side edges. As depicted the belt 120 may be formed from multiple straps and include one or more buckles for release and adjustment of the length thereof as known to those of skill in the art.

In the depicted embodiment, which is intended for use as a daypack for short hikes, the back portion 100 is constructed of a textile material, such as rip-stop nylon or a canvas material. It will be appreciated that any suitable material may be used. In alternative embodiments, which are intended for uses that require a larger pack or a sturdier support structure, the back portion may include a frame made of metal or another material having sufficient strength and rigidity, similar to a typical metal frame backpack. Such an embodiment may be useful for carrying large loads, such as camping equipment for back-country trips or a specialized pack for carrying specialty equipment such as tools.

On the back surface of the back portion 100, are a number of attachment loops 152 which are used to secure an articulating frame 200 to the back portion 100. The attachment loops may be formed from strapping material. In the depicted embodiment B, the attachment loops 152 are sewn to the back portion 100 to permanently attach the articulating frame 200 thereto. In alternative embodiments, the attachment loops 152 may be secured with a hook and loop fastener such as Velcro, or as otherwise known in the art. The number and placement of attachment loops 152 may be varied as desired to achieve sufficient support for the articulating frame 200 and storage compartment S.

It will be appreciated that in other embodiments instead of the attachment loops 152 a plate may be disposed in the back portion 100, as by placement in a pocket or sleeve disposed near the rear surface thereof. Such a pocket may be closed or may be openable to allow the plate and the articulating frame 200 to be detached from the pack. The articulating frame 200 may then be bolted or riveted directly to the plate. The plate may be made out of a suitably strong material, such as plastic, aluminum, steel, carbon fiber, etc., depended on the planned use for the pack. It will be appreciated that in other embodiments where back portion 100 includes a frame, such as a metal frame, the articulating frame 200 may be attached to the back portion 100 by attaching directly to the frame using a suitable fastener, including rivets, bolts, or cotter pins.

A latch receiver LR is secured on the back surface of back portion B and a latch control cable LC may run from the latch receiver along a shoulder strap 102 or 104, secured thereon by one or more latch guide straps 153. The latch receiver LR and latch cable LC will be discussed in more detail further herein.

Figure 5:
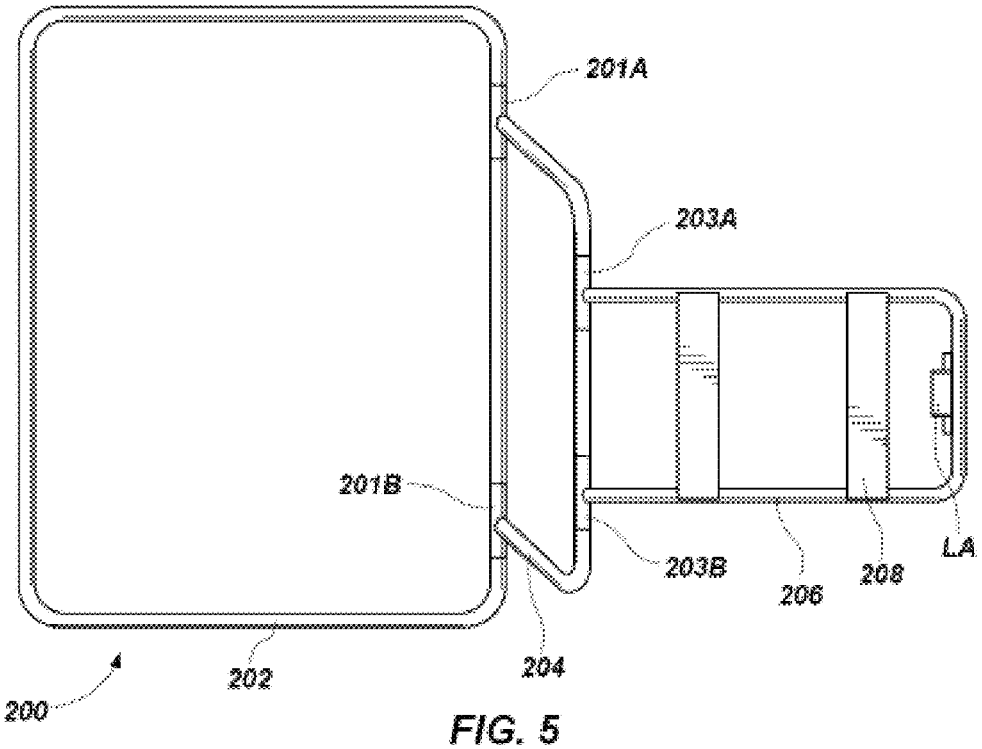
FIGS. 5 and 6 are rear views of the articulating frame of the system of FIGS. 1 through 4 in isolation, showing its configuration in a deployed and undeployed state.
Figure 6:
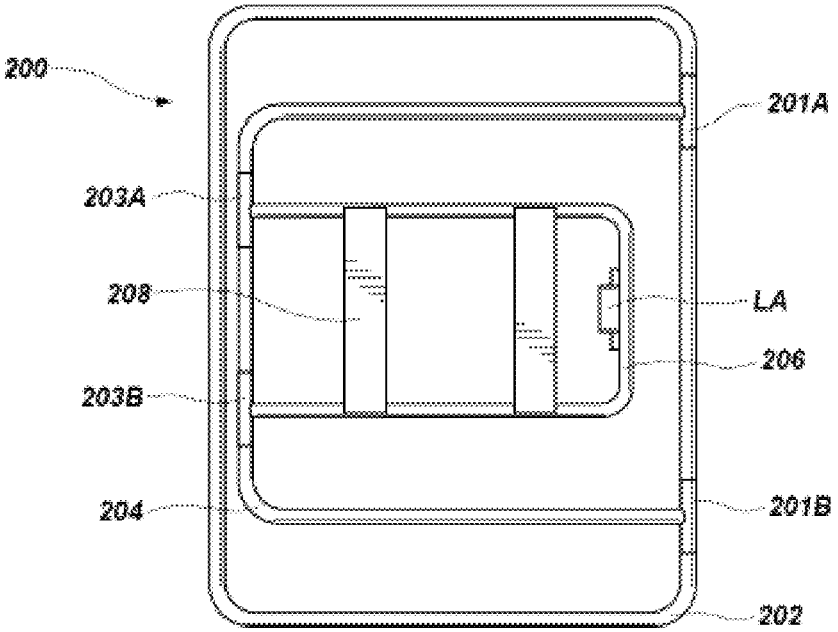

Articulating frame 200 of embodiment B is best depicted in FIGS. 5 and 6 in isolation from the rest of backpack system B. A back section 202 is formed as a large loop which is secured to back portion 100 as discussed previously herein. In the depicted embodiment, back section 202 is formed as a generally rectangular loop having rounded corners. It will be appreciated that although depicted as a loop, the back section 202 may be formed as a plate or other member that is attached to the back portion 100. Along one side section of back section 202, a medial section of the articulating frame 200 is attached thereto as side section 204, which is attached to back loop by two hinges or swivels 201A and 201B. As depicted, side section 204 may be formed as a generally rectangular loop which is smaller in size than the loop of the depicted back section 202, and one side member of the loop of the depicted side section 204 may be shared with back section 202 between the swivels 201A and 201B. It will be appreciated that as depicted, each swivel 201 may be a shorter piece of tubing that resides on the back section 202 loop to which the side section 204 loop is attached. In some other embodiments, the swivels may formed as a single piece of tubing placed over the back section 202 loop from which both the upper and lower portions of side section 204 loop extend.

It will be appreciated that where back section 202 is not a loop, but instead is a plate or other member, the sides section may be a swing arm that attaches thereto with a swivel or hinge in a conventional manner or as is otherwise known in the art.

At the opposite side of the side section 204 opposite the connection to back section 202, a third section of the articulating frame 200 is attached thereto as front section 206. In the depicted embodiment, the front section 206 is formed as a loop, which is attached to the side section 204 loop by two hinges or swivels 203A and 203B. Where formed as a loop, the front section 206 may be formed as a generally rectangular loop which is smaller in size than the loop of side section 204, with one side member of the front section 206 loop shared with the side section 204 loop between the swivels 203A and 203B. As depicted in FIG. 6, in an undeployed position, the front section 206 loop and side section 204 loop may be swiveled to lie within the back section 202 loop. In such a position, the three loops of articulating frame 200 may all lie within a common plane. It will be appreciated that where the front section 206 and side section 204 are not formed as loops, the back section may include recesses into which they may fold so that they reside in a generally common plane in an undeployed position.

Figure 4:
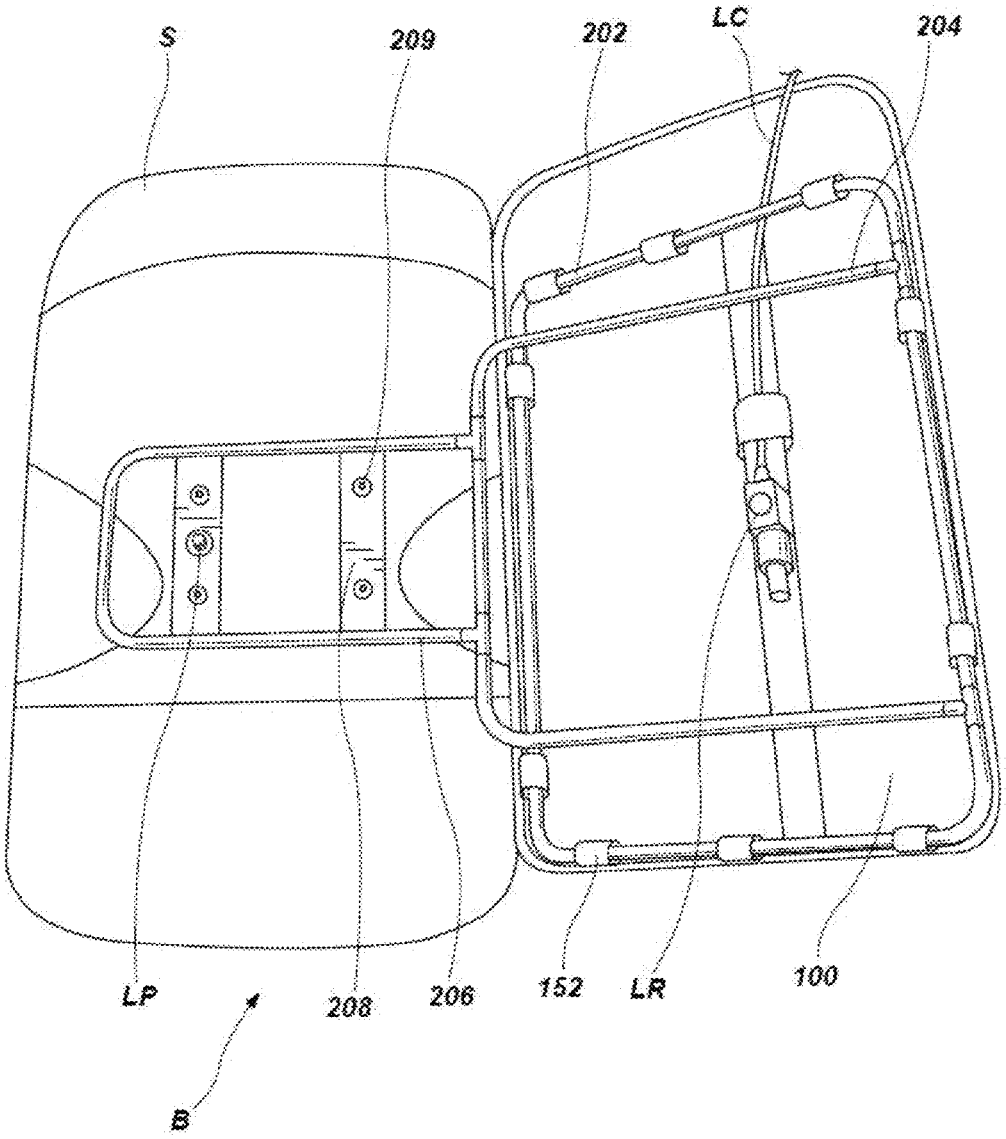
FIG. 4 is a rear view of the system of FIGS. 1 through 3 in a partially deployed state depicting some components thereof.

One or more connection plates 208 may be attached to the front section 206, as be being disposed across a loop formed by the front section 206 and used for connecting the articulating frame 200 to the storage compartment S. As depicted in FIG. 4, this connection may be made by placing screws or bolts 209 through the connection plates 208 to connect to a support structure for the storage compartment S. A latch attachment structure LA (FIGS. 5 and 6) may also be disposed on front section 206 for latching attachment to latch receiver LR. Alternatively, the latch attachment structure may be a latch pin LP as depicted in FIG. 4. It will be appreciated that any latch system having sufficient strength to maintain the system in the undeployed position may be used.

It will be appreciated that although the depicted embodiment uses a tubing-within-tubing hinge system in the form of the three depicted loops that other embodiments of the articulating frame 200 may use an arrangement other than loops, such as a swing arm and hinged member, as discussed previously herein. Further, the articulating frame 200 may be constructed from a suitably strong material such as structural molded plastic, aluminum billet, steel or other metal tubing, carbon fiber or even a titanium weldment, depending upon the load to be carried and the price point of the pack.

The storage compartment S may be formed as a container for holding items to be carried in the backpack. As depicted, the storage compartment S may be formed as a soft sided bag made of textile material which is openable by a zipper. It will be appreciated that in other embodiments, the storage compartment S may be hard sided and formed from suitable materials. Where a textile material is used, the storage compartment may include an internal or external frame for maintaining the shape thereof. Such a frame may be attached to the front loop 206 as discussed previously herein for supporting the storage compartment.

It will be appreciated that the storage compartment may include multiple compartments, such as inner and outer zipper compartments and external pockets on the back or side surfaces. Different configurations of the pockets and compartments may be used for different applications, such as specially sized pockets for camera lenses and photography supplies, fly-fishing equipment, or tools or other specialty gear. Embodiments with configurable pockets that can be adjusted or moved are also contemplated. The storage compartment S may also include external straps for securing gear thereto. For example, a storage compartment S with a flat back surface may have two adjustable horizontal straps thereon disposed vertically apart to allow a snowboard to be secured thereto for winter hiking.

In use, a user can load the backpack system B with desired items to be carried, such as a camera, water, snacks or other supplies for a hike. The storage compartment S is maintained in the undeployed positions adjacent the back portion 100 back surface with the articulating frame 200 folded into a single plane. The latch attachment LA on the front loop 206 is secured in the latch receiver LR. The user wears the system B in standard fashion with the shoulder straps 104 and 106 placed over the shoulders and the belt 120 secured around the torso or waist.

Figure 2:
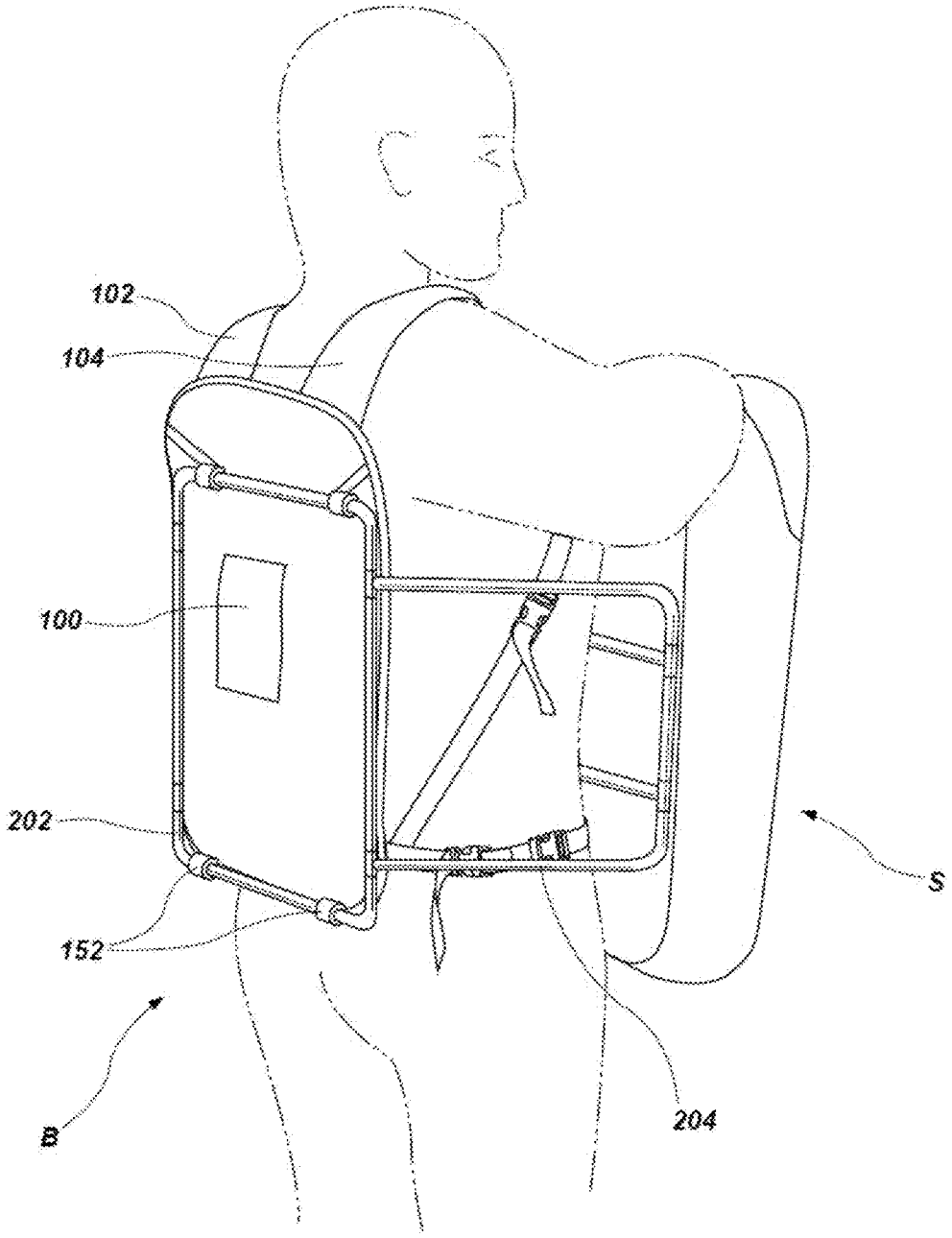
FIG. 2 is a side view of a user wearing the backpack system of FIG. 1 in a deployed configuration.
Figure 3:
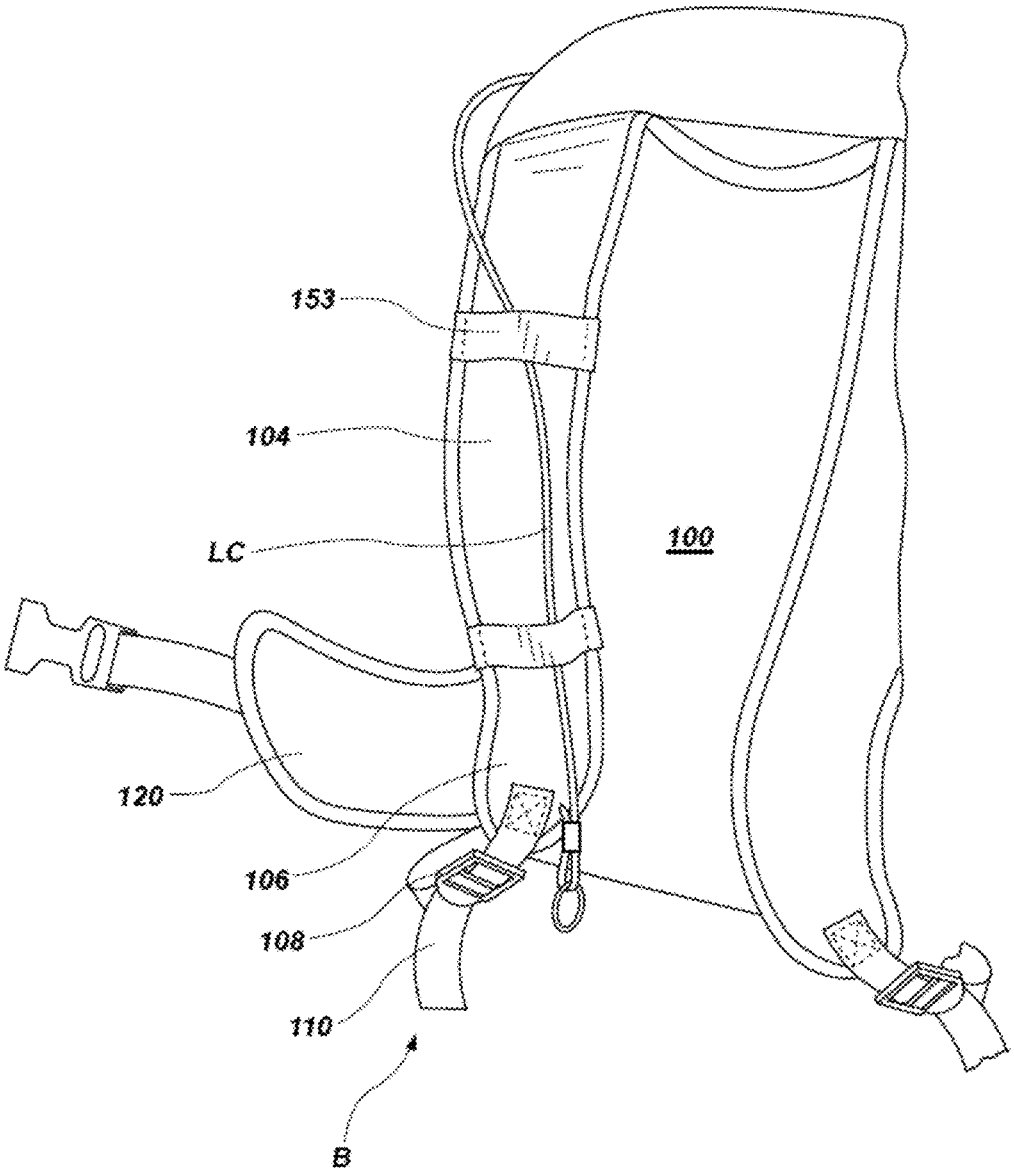
FIG. 3 is a front view of a front side of the back portion of the system of FIGS. 1 and 2.

When the user desires to access to the storage compartment, the user actuates the latch to release the articulating frame 200. In the depicted embodiment, this may be done by pulling on the latch cable LC in front of the user. The user may then swing the storage compartment S around to the user's front. Swivels 201 allow the side section 204 of the articulating frame 200 to move the storage compartment S forward with the side section 204 adjacent the user's side and swivels 203 allow the front section 206 to move the storage compartment S in front of the user with the back side of the storage compartment S facing the user, as depicted in FIG. 2. It will be appreciated that the system B may be designed to place the side section 204 on either the user's left side or right side and systems according to the present invention may be made in both versions for different user's preferences or may be configurable by reversing the frame 200 on back portion if the user so desires.

When finished accessing the storage compartment S, the user then returns the storage compartment S to the undeployed position and the latch is used to secure the articulating frame 200 to retain the swing-around portion in the carrying position.

Figure 7A:
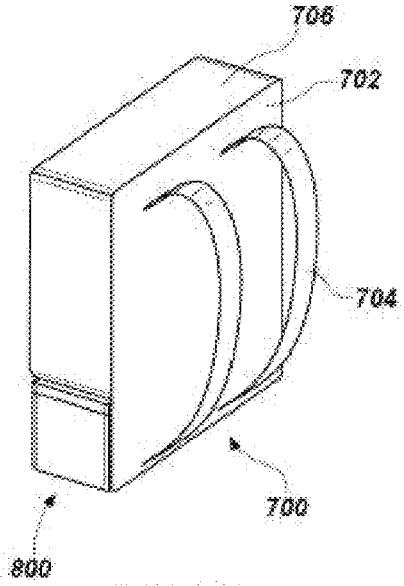
FIGS. 7A through 7C are side perspective views of a second embodiment of a backpack system in accordance with the present invention.
Figure 7B:
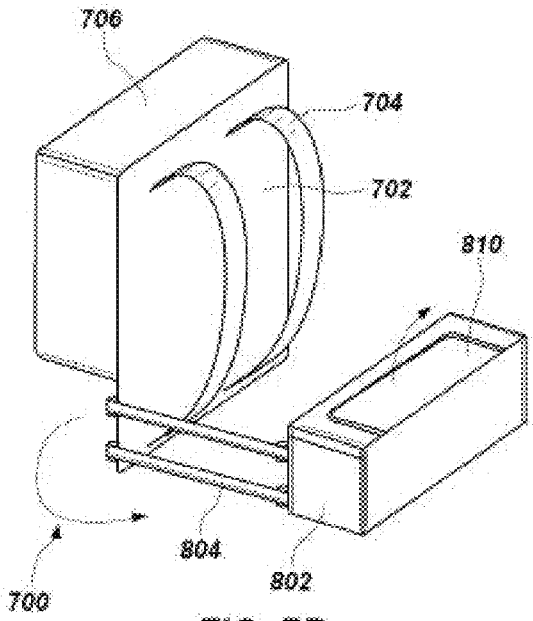
Figure 7C:
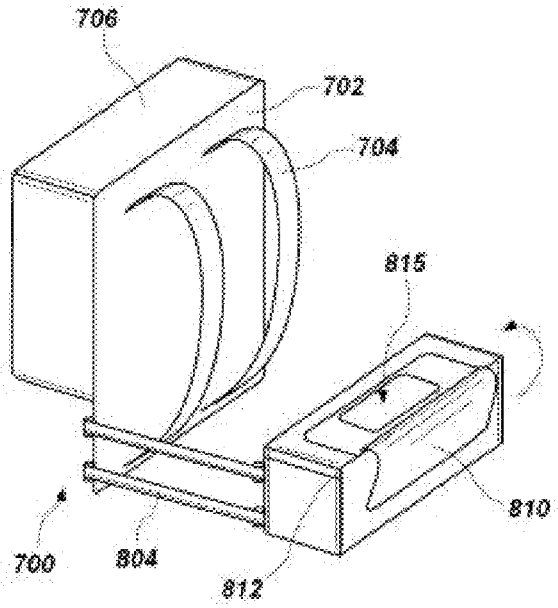

While embodiments of the present invention may include those where the entire storage portion of the pack system may be the swing-around portion with a movable storage compartment S, it will be appreciated that in other embodiments, the pack may include multiple storage compartments that are either fixed to the back portion or function as swing-around portions. For example, depicted in FIGS. 7A to 7C is a backpack system 700 with a back portion 702 including shoulder straps 704 and a storage compartment 706 which is disposed on the back portion 702 and may be accessed in the typical manner of a standard backpack. A swing around portion 800 is formed as a storage compartment 802, attached to an articulating frame 804 that can be deployed as depicted in FIGS. 7B and 7C in the manner discussed previously herein. The storage compartment 802 is thus accessible in front of a user wearing the system. As depicted, the upper face of the storage compartment 802 may include a recess designed for securing a pad computer 815 or other portable electronic or touch-screen device, such as a GPS receiver, therein. A protective cover 810 may be secured with Velcro or other suitable fastener to protect the device during hiking and moved for using the device 815. The remainder of the compartment 802 may be accessed by one or more separate openings 812 that may be zipper closures.

An embodiment similar to that depicted in FIGS. 7A to 7C would allow a user not only to carry an electronic device, but also to swing it around and actually type on it with both hands, search the internet, read a book or watch a movie without removing the pack. This may be especially useful with a pad computer which is fairly small, and is placed flat in a thin section on the top of the lower swing-around section as depicted. This allows the computer to be completely protected while integrated with the pack, but easily accessible in a flat and right-side-up position by activating the swing-around feature. Similarly, while the size of most modern laptop computers would require that they be carried vertically on the back of the pack, a laptop could be carried in a separate section that would swing around. Once around, the laptop section, which would have a rotating attachment to rotate to a comfortable angle for use. In both cases, a clip on the side of the pack opposite the hinge may be included to allow the "computer desk" to be completely stabilized.

Similarly, the swing around portion could provide a stable platform which is generally horizontal in front of the user, which could then be stabilized by a second clip around the user's other side. Equipment or tools could be deployed on the platform as needed.

It will be appreciated that although FIGS. 7A to 7C depicts a system 700 with a single swing around portion 800 consisting of a lower storage compartment, that embodiments having different configurations or differing numbers of swing around portions may be used. For example, packs that are large or particularly heavy can be split as in FIG. 7, so that a middle or lower section swings around for access while the upper section remains in place. This can allow the access system to be used, for example, with a tall trekking pack that extends above the shoulders of the wearer, while allowing the heaviest part of the pack to remain fixed, with only the items that the wearer will need to access swinging around. In another example intended as a child's school pack, heavy items such as books could be loaded in the portion of the pack higher up on the back, which remains fixed, while the lighter items to which frequent access is desired are in the swing-around portion. Other embodiments include side-by-side swing around sections, which swings around opposite sides of a user.

Figure 8A:
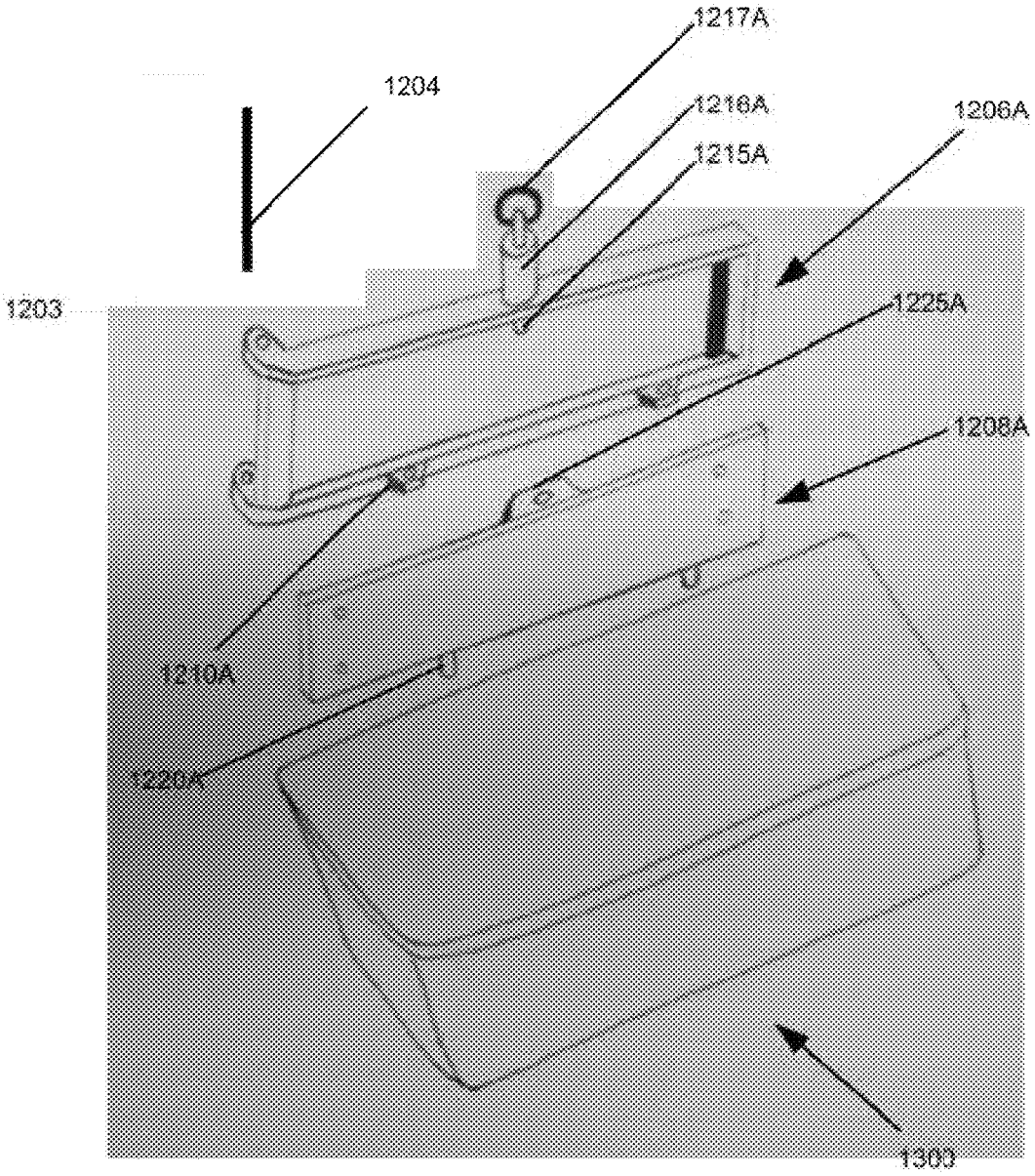
FIGS. 8A and 8B are rear perspective exploded views of a portion of articulating frames and removable storage compartments useful with systems in accordance with the present disclosure.
Figure 8B:
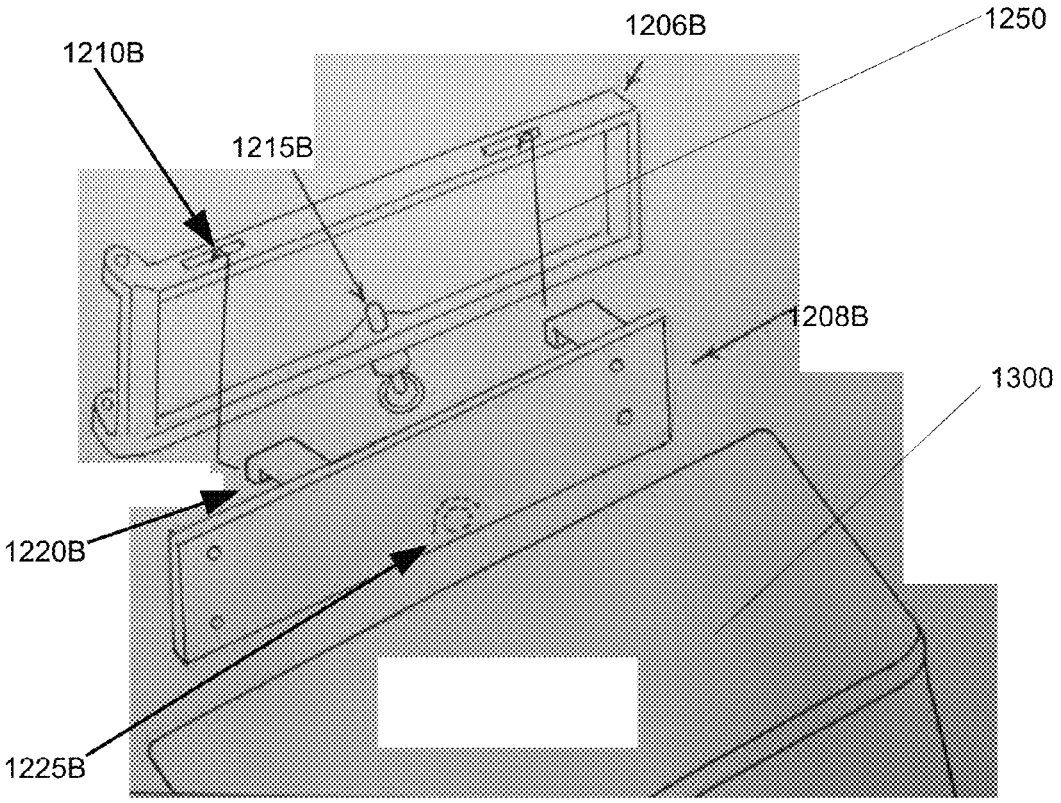

Turning to FIGS. 8A and 8B, different embodiments of front section 1206 that may be useful in various applications of the present disclosure are depicted. These allow for the use of a removable storage compartment that can be detached from the articulating frames discussed previously herein. This can allow additional flexibility for a user owning a system in accordance with the present disclosure. For example, multiple storage compartments 1300 which have different configurations of the pockets and compartments therein and may be used for different applications, such as specially sized pockets for cameras or flyfishing, as discussed previously herein, could be exchangeably attached and detached from a system. This can enable a user to hike with the desired confirmation or equipment without the need to unpack, reconfigure and repack the storage compartment 1300.

As depicted in FIG. 8A, one way in which the storage compartment may be removed and replaced is by having a front section 1206A that detaches from the remainder of the articulating frame 200 by a disassembly of the hinge assembly, generally indicated at 1203. A removable hinge pin 1204 may be lifted from the hinge assembly and the front section 1206A with an attached storage compartment removed. It (or another front section 1206A) may then be reattached to the frame 200 by aligning the hinge assembly and reinserting the removable hinge pin 1204. The hinge pin 1204 may be spring loaded or include locking tabs to facilitate removal and reinsertion.

FIG. 8A further illustrates a second manner in which a storage compartment 1300 may be detachable. The storage compartment 1300 may be attached to a connector plate 1208A, as discussed previously herein, which detachable from the front section 1206A. In the depicted embodiment, the removable connection plate 1208A includes one or more guide pins 1220A extending from a lower end thereof that may be inserted into corresponding receptacles on the front section 1208A, such as those disposed in the pin brackets 1210A.

The removable connection plate 1208A and front section 1206A also includes a securing mechanism to retain the connection plate 1208A in place. In the depicted embodiment, the connection plate 1208A includes a bracket 1225 near a top edge thereof for receiving a locking pin 1215A disposed on the front section 1206A. As depicted, the locking pin may include a spring in a jacket or sleeve 1216A to urge the pin to the secured extended position and may include a handle or pull ring 1217A to facilitate use by a user. A user can then simply pull the ring 1217A to remove distal end of the pin 1215A from the bracket 1225A and lift the storage compartment 1300 and attached connector plate 1208A from the system. It (or another storage compartment 1300) may then be reattached by inserting the guide pins 1220A into the pin brackets 1210A and securing the locking pin 1215A in the bracket 1225A.

Similarly, FIG. 8B illustrates one alternative manner in which a storage compartment 1300 may be detachable. As with the previously discussed embodiment in FIG. 8A, the storage compartment 1300 may be attached to a detachable connector plate 1208B. Removable connection plate 1208B includes one or more slip lock guide tabs 1220B which are formed as planar members extending from the upper end of the connector plate 1208B to a downwards extending tab. As indicated by arrows 1250, the end of a guide tab 1220B may be inserted into corresponding receptacles on the front section 1208B, such as the slots 1210B accessible on an upper surface thereof.

The removable connection plate 1208B and front section 1206B also include a securing mechanism to retain the connection plate 1208B in place. In the depicted embodiment, the connection plate 1208B includes a bracket 1225B near a lower end thereof for receiving a locking pin 1215B disposed on the front section 1206B. As depicted, the locking pin may include a spring in a jacket or sleeve to urge the pin to the secured extended position and may include a handle or pull ring to facilitate use by a user. A user can then simply pull the ring to remove distal end of the pin 1215B from the bracket 1225B and lift the storage compartment 1300 and attached connector plate 1208B from the system. It (or another storage compartment 1300) may then be reattached by inserting the guide tabs 1220B into the slots 1210B and securing the locking pin 1215B in the bracket 1225B.

It will be appreciated that embodiments depicted in FIGS. 8A and 8B are only illustrative and that other mechanisms that allow for the use of modular detachable storage compartments with a system in accordance with the present invention, such as attaching and detaching a connector plate 1208 from a front section 1206, or by replacing a front section 1206, may be used.

The present invention further includes kits for modifying existing backpacks to include a swing around portion are also included in the present invention. Such a kit may include a storage compartment and an articulating frame for attachment to an existing backpack.

While this invention has been described in certain embodiments, the present invention can be further modified with the spirit and scope of this disclosure. This application is therefore intended to cover any variations, uses, or adaptations of the invention using its general principles. Further, this application is intended to cover such departures from the present disclosure as come within known or customary practices in the art to which this invention pertains and which fall within the limits of the appended claims.

What is claimed is:

1. A backpack system comprising:

a back portion comprising a base which may be worn parallel to a user's back;

at least one storage compartment; and an articulated frame comprising a first section connected to the back portion, a second section pivotally attached to the first section for rotation therefrom in a generally horizontal direction when the system is on a user's back, and a third section pivotally attached to the second section for rotation therefrom in a generally horizontal direction when the system is on a user's back, the third section attached to the at least one storage compartment such that rotation of the articulated frame places the at least one storage compartment in front of the user wearing the system with the second section of the articulated frame disposed along the user's side, wherein a back side of the at least one storage compartment faces the user when rotated in front of the user in a deployed position and faces the user when rotated to the back portion in an undeployed position, and wherein in the undeployed position the second section and third section are both disposed along the back of the user.

2. The system of claim 1, wherein the at least one storage compartment is detachable from the system.

3. The system of claim 2, wherein the third section is attached to the at least one storage compartment via a connector plate attached to the at least one storage compartment and the connector plate is releasably secured to the third section.

4. The system of claim 3, wherein the connector plate is releasably secured to the third section by a sliding pin that is inserted into a bracket on the connector plate.

5. The system of claim 3, wherein the connector plate is releasably secured to the third section by insertion of a member extending from the connector plate into a corresponding recess formed in the third section.

6. The system of claim 2, wherein the third section pivotally attached to the second section for rotation therefrom in a generally horizontal direction when the system is on a user's back comprises the third section being pivotally attached to the second section using a hinge with a removable hinge pin.

7. The system of claim 1, wherein the system further comprises at least a second storage compartment.

8. The system of claim 7, wherein the at least a second storage compartment is attached directly to the back portion.

9. The system of claim 7, wherein the at least a second storage compartment is attached to a second articulated frame comprising a first section connected to a rear surface of the back portion, a second section pivotally attached to the first section for rotation therefrom in a generally horizontal direction when the system is on a user's back, and a third section pivotally attached to the second section for rotation therefrom in a generally horizontal direction when the system is on a user's back, such that rotation of the second articulated frame places the at least a second storage compartment in front of the user wearing the system with the second section of the second articulated frame disposed along the user's side.

10. The system of claim 9, wherein the articulated frames rotate around opposite sides of the user.

11. The system of claim 1, wherein in the undeployed position the second section and third section are both disposed along the back of the user with the second section at least partially folded into the first section.

12. The system of claim 11, wherein in the undeployed position the second section and third section are at least partially folded into a recess in the first section.

13. The system of claim 1, wherein in the undeployed position the second section and third section are both disposed along the back of the user and generally reside parallel to one another.

14. An articulated frame for rotating a detachable structure on a backpack around a user wearing the backpack for accessing the detachable structure in front of the user while wearing the backpack, the articulated frame comprising:

a first section for connection to a portion of a backpack worn on the back of the user;

a second section pivotally attached to the first section for rotation therefrom in a generally horizontal direction when the system is on a user's back; and a third section pivotally attached to the second section for rotation therefrom in a generally horizontal direction when the system is on a user's back, the third section releasably attached to the detachable structure such that rotation of the articulated frame places the detachable structure in front of a user wearing the backpack including the articulated frame with the second section of the articulated frame disposed along the user's side, wherein a back side of the structure faces the user when rotated in front of the user in a deployed position and faces the user when rotated to the back portion in an undeployed position, and wherein in the undeployed position the second section and third section are both disposed along the back of the user.

15. The articulated frame of claim 14, wherein the detachable structure comprises at least one storage compartment.

16. The articulated frame of claim 14, wherein the third section is releasably attached to the detachable structure by a connector plate which is releasably secured to the third section.

17. The articulated frame of claim 16, wherein the connector plate is releasably secured to the third section by a sliding pin that is inserted into a bracket on the connector plate.

18. The articulated frame of claim 16, wherein the connector plate is releasably secured to the third section by insertion of a member extending from the connector plate into a corresponding recess formed in the third section.

19. The articulated frame of claim 14, wherein in the undeployed position the second section and third section are both disposed along the back of the user with the second section at least partially folded into the first section.

20. The articulated frame of claim 19, wherein in the undeployed position the second section and third section are at least partially folded into a recess in the first section.

* * * * *